United States Patent [19]

Sorteberg

[11] 4,323,769

[45] Apr. 6, 1982

[54] SELF-ALIGNING SCALING LOAD CELL

[76] Inventor: Johannes Sorteberg, 80 Delafield Island Rd., Darien, Conn. 06820.

[21] Appl. No.: 163,226

[22] Filed: Jun. 26, 1980

[51] Int. Cl.[3] ..... G06G 5/00

[52] U.S. Cl. ..... 235/200 WB

[58] Field of Search ..... 235/200 WB

[56] References Cited

U.S. PATENT DOCUMENTS 3,243,112 3/1966 Sorteberg ..... 235/200 WB

*Primary Examiner*—L. T. Hix
*Assistant Examiner*—Thomas H. Tarcza
*Attorney, Agent, or Firm*—F. Eugene Davis, IV

[57] ABSTRACT

The force from a pneumatic load cell is supplied via a push rod to a carriage, the push rod directly acting on an axle bearing outrigger wheels riding on an adjustable plane. The output force is supplied from the axle through another push rod acting on the axle, the two push rods defining a plane at substantially right angles thereto. The first push rod fits in a sleeve in the carriage which allows the carriage to rotate about the axis of the first push rod. The second push rod is guided against lateral motion in the plane defined by the first push rod and the axle. The end thereof acting on the axle is surrounded by a cone shaped guide in the carriage. The latter guide allows the carriage to rotate in three dimensions but prevents lateral displacement with respect to the end of the second push rod.

The pneumatic load cell may be supplied with a positive or negative spring providing a biasing force. The output push rod is provided with a positive spring, the zero point of which is adjustable. When spring biased, the output push rod is divided into two pieces which freely pivot at their juncture.

18 Claims, 8 Drawing Figures

FIG. 6
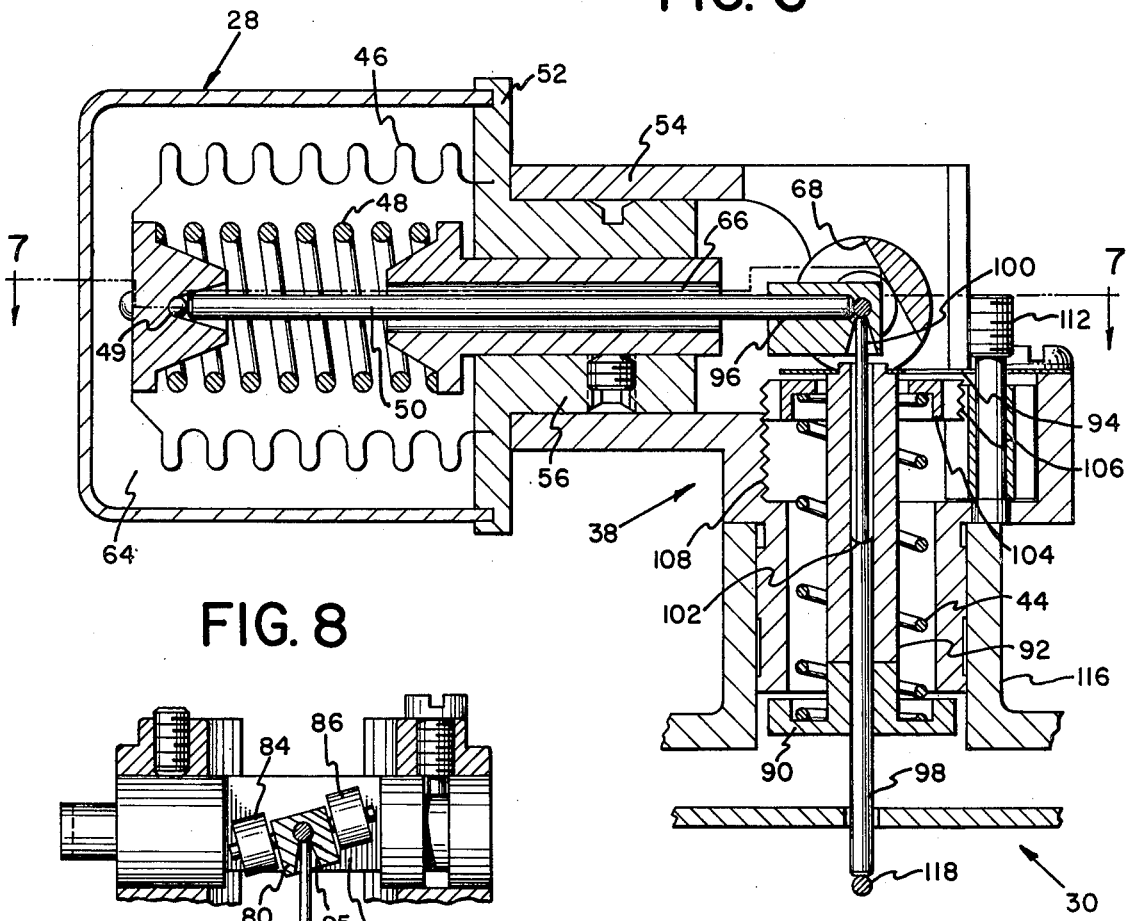
FIG. 8
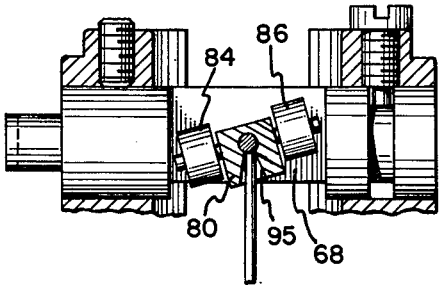
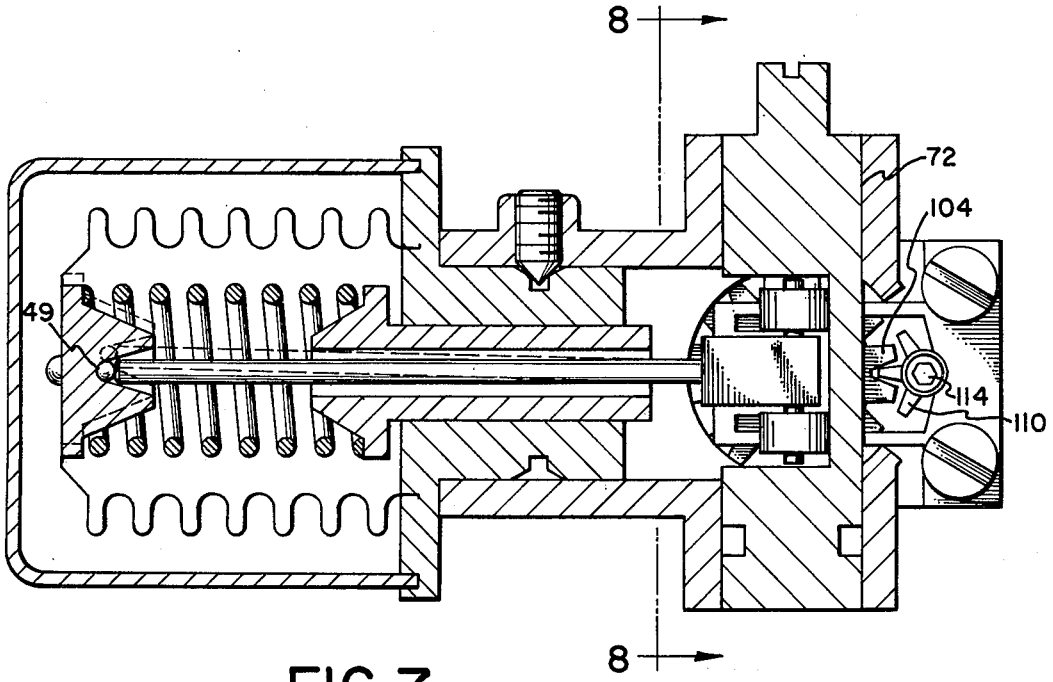
FIG. 7

SELF-ALIGNING SCALING LOAD CELL

TECHNICAL FIELD

This invention relates to self-aligning scaling load cells. More particularly it relates to such load cells for use in pneumatic analog computers.

BACKGROUND ART

Pneumatic analog computers are used in industry to perform various calculations in process control and measurement. The self-aligning scaling load cells of the present invention are adapted for use in the automatically balanced weighbeam system pneumatic analog computers disclosed in my U.S. Pat. No. 2,918,214, issued Dec. 22, 1959; U.S. Pat. No. 3,085,744, issued Apr. 16, 1963; U.S. Pat. No. 3,190,553, issued June 22, 1965; and U.S. Pat. No. 3,289,933, issued Dec. 6, 1966. Pneumatic analog computers of this type are manufactured and sold under the Trademark FORCE BRIDGE by Sorteberg Controls Corporation, 111 Glover Avenue, Norwalk, Conn. 06850.

In my earlier U.S. Pat. No. 3,243,112, issued May 29, 1966 entitled WEIGHBEAM SYSTEM I disclosed a novel scaling load cell. The present invention is an improvement on the scaling load cell disclosed and claimed therein.

DISCLOSURE OF THE INVENTION

The scaling load cell disclosed in my U.S. Pat. No. 3,243,112 is a good idea. Unfortunately however, until now, I was never able to make it work in a highly practicable fashion. The problem is that the bellows and the springs of the pneumatic load cells (pressure to force transducers) are not perfect and as they contract or expand the point at which their force is transmitted to a push rod for scaling in the scaling device wanders laterally. In the apparatus disclosed in my above U.S. patent, this caused the wheel bearing of the scaling device to wander on the adjustable plane and the output to therefore depart from a linear ratio to the input.

I have now discovered that these problems with my prior device may be overcome by providing the scaling device with a carriage having outrigger wheels operating on the adjustable plane. The wheels are mounted on an axle and the push rods of the device operate directly on the axle between the wheels. The push rod which is acted upon by the pneumatic load cell is slip-fit into a sleeve which allows the carriage to rotate about it when the pneumatic load cell push rod is moved laterally. The output push rod is guided in its axial motion. The carriage guides the end of the output push rod so that it cannot move with respect thereto. The result is that a lateral motion of the load cell end of the input push rod rotates the carriage about the output push rod which causes the outrigger wheels to rotate the carriage on the plane to a new equilibrium position cancelling lateral displacement errors. The resultant output force is a linear function of the input force and there is no dead band error.

Another problem I have found in the construction disclosed in my prior device is that when the output push rod is spring biased the output push rod also wanders laterally at the place where the spring bias is applied. I have found that if a solid output push rod is used erroneous forces will be placed on the carriage and the output force will not be a linear function of the input pressure to the device. I have cured this problem by dividing the output push rod into two pieces, one riding freely against the other.

OBJECTS OF THE INVENTION

It is therefore an object of the invention to provide improved scaling load cells.

Another object of the invention is to provide such load cells which are self-aligning.

A further object of the invention is to provide such load cells in which the output force is a pure linear ratio of the input force.

Still another object of the invention is to provide such load cells having no dead band error.

Still another object of the invention is to provide such load cells for use in pneumatic analog computers.

Other objects of the invention will in part be obvious and will in part appear hereinafter. The invention accordingly comprises the features of construction, elements and arrangements of parts possessing the features, properties and relation of elements all of which will be exemplified in the construction hereinafter described. The scope of the invention will be indicated in the claims.

BRIEF DESCRIPTION OF THE DRAWINGS

For a fuller understanding of the nature and objects of the invention reference should be had to the following detailed description taken in connection with the accompanying drawings in which:

FIG. 6 is an enlarged cross sectional view taken along the line 6—6 of FIG. 2 of apparatus having adjustable spring bias;

FIG. 7 is a cross sectional view taken along the line 7—7 of FIG. 6; and FIG. 8 is a diagramatic cross sectional view taken along the line 8—8 of FIG. 7.

The same reference characters refer to the same elements throughout the several views of the drawings.

BEST MODE FOR CARRYING OUT THE INVENTION

Figure 1:
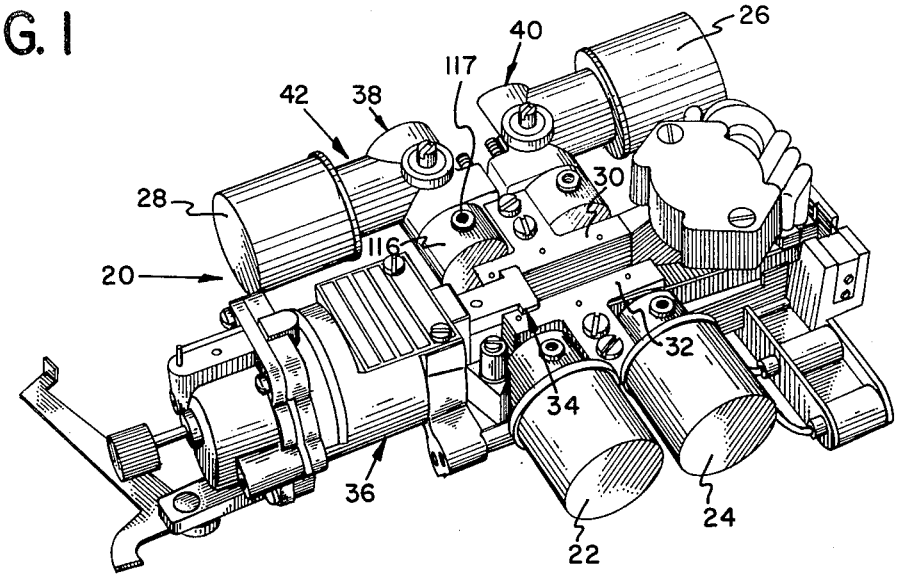
FIG. 1 is a perspective view of a pneumatic analog computer utilizing two scaling load cells according to the invention.

Now referring to FIG. 1, a pneumatic analog computer according to my above-identified prior patents is generally indicated at 20. It comprises four pneumatic load cells 22, 24, 26 and 28, which act upon a pair of weighbeams 30 and 32, supported on commonly positioned fulcrums 34. The fulcrums are moved by means of a air motor generally indicated at 36. For some purposes one or more of the load cells may be replaced by springs. Apparatus for converting load cells 26 and 28 to self-aligning scaling load cells is generally indicated at 38 and 40; apparatus 40 being the mirror image of apparatus 38. Thus a self-aligning scaling load cell generally indicated at 42 is shown in detail in FIGS. 2 through 8. in FIG. 5 there is shown the detail of the scaling apparatus generally indicated at 38, in which there is no adjustable spring bias on the output. In FIG. 6 a spring 44 is shown and a slight modification is made in the load cell to accommodate it, as will be detailed below.

Now referring to FIGS. 2 through 8, the load cell 28 is conventional. Specifically referring to FIG. 6, it comprises a compressible bellows 46. It may be supplied with a biasing spring 48. An output pivot is provided by ball bearing 49 against which push rod 50 is free to pivot. The load cell is provided with an airtight housing 52. The scaling apparatus generally indicated at 38 is provided with a tube extension 54 which receives cylindrical portion 56 of the housing 52.

Figure 3:
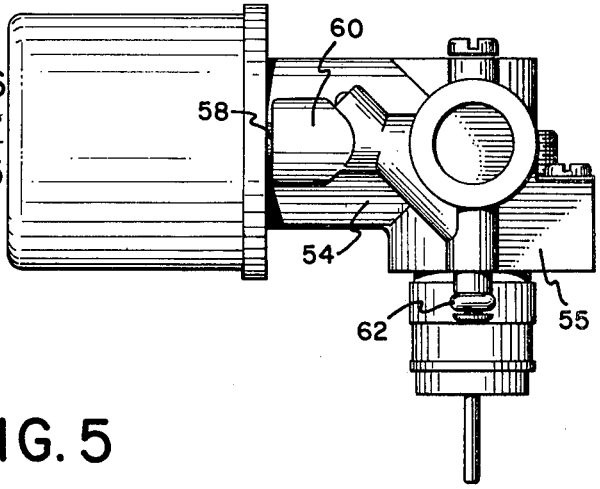
FIG. 3 is an enlarged side view of a load cell of FIG. 1.

Now referring to FIG. 3, air is supplied to the load cell through an air supply nipple 58 fitted into an air supply tube 60 which is an integral portion of the housing 55. Air thus ultimately is supplied to the load cell through nipple 62.

Again referring to FIG. 6, the air supplied to the space 64 surrounding the bellows 46 causes the bellows to contract, the inner portion of the bellows 46 being open to the atmosphere through the space 66 surrounding push rod 50.

As previously explained, when bellows 46 expands and contracts, pivot ball 48 does not move in a straight line, but wanders around the nominal axis of push rod 50. This angularly displaces push rod 50 from its nominal position to that as shown in FIG. 7 in dotted lines for example.

Figure 2:
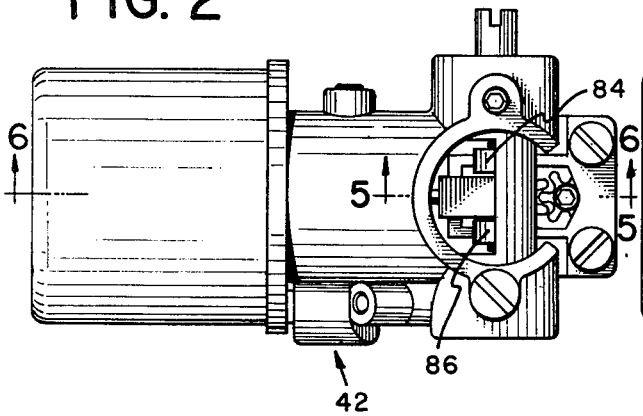
FIG. 2 is an enlarged top view of a load cell of FIG. 1.
Figure 4:
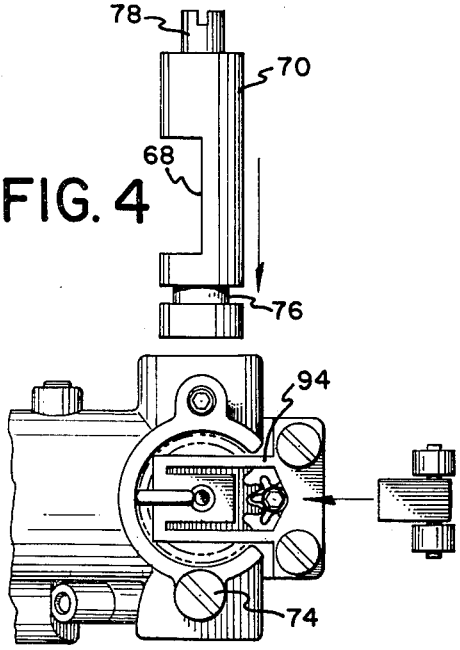
FIG. 4 is an enlarged exploded view, partially cut away, of a load cell of FIG. 1.
Figure 5:
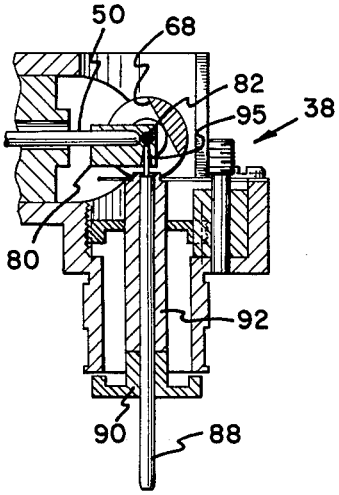
FIG. 5 is a partial cross sectional view taken along the line 5—5 of FIG. 2 of apparatus having no adjustable spring bias.

Push rod 50 is the input push rod to the scaling device 38. As best seen in FIGS. 2 and 4, scaling device 38 is provided with an angularly adjustable plane 68 which is formed on and coincident with the axis and diameter of cylinder 70. Cylinder 70 fits into a cylindrical channel 72 (FIG. 7) in housing 54 and is held against axial motion by means of set screw 74 which fits into annular recess 76 in cylinder 70. The plane may be adjusted by means of the screw-like extension 78. As shown in FIGS. 5 and 7, the plane is located in an inclined manner with respect to the input push rod 50.

Input push rod 50 fits into carriage 80 having an axle 82 fixed therein. As shown in FIGS. 2, 7 and 8, axle 82 extends beyond the carriage 80 and has mounted thereon a pair of ball bearings or wheels 84, 86, having flat, that is right circular cylindrical outer rims. The wheels 84 and 86 ride on the plane 68.

Now referring to FIG. 5, output push rod 88 acts on axle 82 at the same position as input push rod 50. Thus, push rods 50 and 88 define a plane. Plane 68 is perpendicular thereto as is axle 82 if the input push rod 50 is at its nominal position as shown in FIG. 6. Output push rod 88 is provided with a collar 90 fixed thereto supporting a guide sleeve 92. A guide spring 94 engages the upper end of sleeve 92 and keeps the push rod 88 from any lateral motion at that position. The upper end of push rod 88 which acts against the axle 82 fits in carriage 80 in a conical shaped recess 94 which prevents any lateral motion of the upper end of push rod 88, but allows angular motion of the carriage 80 about the pivot between the end of the push rod 88 and the axle 82.

As best seen in FIGS. 6, 7 and 8, when input push rod 50 moves laterally, as shown in dotted lines in FIG. 7, outer wheel 86 would normally tend to lift off the plane 68. However, because of the force from the plane 68 on the other wheel 84, the carriage is caused to rotate counterclockwise, as shown in FIG. 8, assuming a new equilibrium position as shown there. Thus, it will be seen that it is necessary for the carriage 80 to be able to rotate about the axis of push rod 50. I prefer to provide a very free motion and thus allow push rod 50 to rotate with respect to the pivot bearing 48 in the load cell 28 and also allow free motion of the carriage 80 about the push rod 50 by means of a slip fit at 96 (FIG. 6). The cone shaped recess 94 permits free pivoting of the carriage 80 about the output push rod 88.

Now referring to FIG. 6. When it is desired to provide an adjustable spring bias on the output push rod, I utilize a two-piece push rod comprising large rod 98 and small rod 100. Large rod 98 is provided with a recess 102 at the top thereof, in which small rod 100 is seated and in which it may pivot freely. Spring 44 acts between collar 90 and an adjustable stop 104.

Spring 44 is subject to the same difficulties as the load cell 28 in that as it expands and contracts it tends to move collar 90 laterally. This lateral motion is accommodated by the pivot at 102. I provide the same guide sleeve 92 and guide spring 94.

Stop 104 has gear teeth, that is, it is a gear, around the outer periphery thereof, as best seen in FIGS. 2, 4 and 7. The outer periphery of the gear teeth are provided with screw threads 106 threaded into receiving screw threads 108 in the housing 54. Thus the stop 104 may be adjusted up and down by rotating a pinion 110 engaging the gear teeth on stop 104. Pinion 110 is turned by means of extension 112 which may be provided with an Allenhead type recess.

The entire scaling apparatus 38 and load cell 28 fit into the standard load cell receiving collar 116 on the pneumatic analog computer apparatus 20 shown in FIG. 1 and is held therein by set screw 117. The output of the output push rods 98 and 88 act upon a pivot wire 118 located within the weighbeam assembly 30.

By adjusting the angular position of the inclined plane 68 the input force produced by the load cell 28 may be ratioed from zero to infinity to produce any desired output force on the output push rods 88 and 98. If desired, adjustable bias may be provided by the spring 44. The biases provided by springs 44 and 48 may be positive or negative. Those skilled in the art will understand that only very small motions ever occur in the apparatus. For this reason it is believed that the embodiment with the spring 44 as shown in FIG. 6 does not bind as those skilled in the art might suspect since there is no restraint on the lateral motion of the carriage 80. On the other hand, in the embodiment shown in FIG. 5, where there is no biasing spring and a unitary output push rod 88 which is guided by means of guide spring 94 and guide sleeve 92, the carriage is prevented from any lateral motion and thus no binding could occur even if large motions were employed.

It will thus be seen that the objects set forth above among those made apparent from the preceding description are efficiently attained and since certain changes may be made in the above described constructions without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which as a matter of language might be said to fall therebetween.

Having described my invention what I claim as new and desire to secure by Letters Patent is:

1. In a scaling load cell comprising a pair of push rods acting on a carriage riding on a plane substantially perpendicular to the plane defined by said rods, said carriage having an axle, said perpendicular plane angularly adjustable about an axis substantially perpendicular to the plane of said rods and intersecting said carriage whereby forces applied to one of said push rods produce forces on the other push rod at a ratio adjustable by adjusting said adjustable plane; the improvement comprising said push rods being in physical contact with and applying said forces directly to said axle.

2. In a scaling load cell as defined in claim 1, the further improvement comprising a pair of outrigger wheels on said carriage mounted on an axle substantially coincident with said perpendicular axis.

3. A scaling load cell as defined in claims 1 or 2 wherein there is a cylindrical recess in said carriage through which one of said push rods acts on said axle, said cylinder being just large enough to accommodate free rotary motion of said carriage about said push rod.

4. In a scaling load cell as defined in claim 3, the further improvement comprising guide means on said carriage for guiding the end of said other push rod against said axle at a fixed location, but allowing for angular motion of said carriage about the end of said first push rod.

5. A scaling load cell as defined in claim 4 wherein the end away from said carriage of said push rod fitted in the cylindrical recess in said carriage moves laterally as different forces are applied thereto.

6. In a scaling load cell as defined in claim 5, the further improvement comprising guide means for limiting the lateral motion of said other push rod.

7. A scaling load cell as defined in claim 6 wherein said guided push rod acts upon a weighbeam and said other push rod is driven by a pneumatic transducer.

8. A scaling load cell as defined in claim 6 wherein said outrigger wheels have right circular rims.

9. A scaling load cell as defined in claims 1 or 2, the further improvement comprising an adjustable spring acting on one of said push rods.

10. A scaling load cell as defined in claim 9 wherein said spring is located between a collar on said push rod and an adjustable stop comprising a outer geared open cylinder screw threaded about the outer periphery of the gear.

11. A scaling load cell as defined in claim 2 wherein said outrigger wheels have right circular cylindrical rims.

12. In a scaling load cell as defined in claims 1 or 2, the further improvement comprising means preventing lateral motion of said carriage with respect to the ends of said push rods, but permitting free rotation around the axes of said push rods.

13. In a scaling load cell as defined in claim 12, the further improvement comprising guide means for limiting the lateral motion of a mid portion of said one of said push rods.

14. In a scaling load cell as defined in claim 13, the further improvement comprising a spring acting on said one of said push rods at a position away from said carriage on the other side of said mid portion.

15. A scaling load cell as defined in claim 14 wherein said one of said push rods is divided into two rods between said mid portion and said carriage, the rod between said division and said carriage being forced to pivot angularly at the end thereof away from said carriage.

16. In a scaling load cell as defined in claim 15, the further improvement comprising means allowing angular motion of said carriage with respect to the end of one of said push rods.

17. A scaling load cell as defined in claim 15, further defined in that there is a first rod having a collar affixed thereto; said spring is a compression spring acting on said collar; a sleeve surrounding said first rod and extending from said collar to beyond the end thereof; a leaf spring acting on the outer end of said sleeve to permit axial motion thereof but prevent lateral motion; the end of said first rod being recessed; a second rod, one end thereof fitted in said recess for free angular motion and the other end thereof acting on said axle.

18. A scaling load cell as defined in claim 17, the further improvement comprising means allowing angular motion of said carriage with respect to the end of one of said push rods.

* * * * *